US007294097B2

(12) United States Patent
Parker

(10) Patent No.: US 7,294,097 B2
(45) **Date of Patent: *Nov. 13, 2007**

(54) ARTICULATED BENCH

(76) Inventor: James Parker, 106 Shelbourne Dr., York, PA (US) 17403

( * ) Notice: Subject to any disclaimer, the term of this patent is extended or adjusted under 35 U.S.C. 154(b) by 238 days.

This patent is subject to a terminal disclaimer.

(21) Appl. No.: 11/040,755

(22) Filed: Jan. 22, 2005

(65) Prior Publication Data

US 2005/0197238 A1 Sep. 8, 2005

Related U.S. Application Data

(60) Provisional application No. 60/538,542, filed on Jan. 23, 2004.

(51) Int. Cl.
*A63B 26/00* (2006.01)

(52) U.S. Cl. ..... 482/142; 482/148

(58) Field of Classification Search ..... 482/142; D21/676, 686, 690

See application file for complete search history.

(56) References Cited

U.S. PATENT DOCUMENTS

| | | | | | |
|---|---|---|---|---|---|
| 2,208,945 | A * | 7/1940 | Miller | 297/170 |
| 3,342,485 | A * | 9/1967 | Gaul | 482/145 |
| 4,423,865 | A * | 1/1984 | Mahnke | 482/104 |
| 4,635,934 | A * | 1/1987 | Roethke | 482/104 |
| 4,653,751 | A * | 3/1987 | Green | 482/104 |
| 4,749,190 | A * | 6/1988 | Jennings | 482/104 |
| 4,960,277 | A * | 10/1990 | LaRossa et al. | 482/104 |
| 5,176,603 | A * | 1/1993 | Hundley et al. | 482/140 |
| 5,232,426 | A * | 8/1993 | Van Straaten | 482/123 |
| 5,350,346 | A * | 9/1994 | Martinez | 482/142 |
| 5,462,510 | A * | 10/1995 | Ish, III | 482/142 |
| 5,649,886 | A * | 7/1997 | Danylieko | 482/142 |
| 5,882,283 | A * | 3/1999 | Stevens | 482/104 |
| 5,993,360 | A * | 11/1999 | Stevens | 482/104 |
| 6,245,001 | B1 * | 6/2001 | Siaperas | 482/142 |
| 6,264,586 | B1 * | 7/2001 | Webber | 482/104 |
| 6,287,243 | B1 * | 9/2001 | Isom et al. | 482/142 |
| 6,605,023 | B1 * | 8/2003 | Mobley | 482/142 |
| 6,645,130 | B2 * | 11/2003 | Webber | 482/104 |
| D519,585 | S * | 4/2006 | Webber | D21/690 |
| 2006/0035772 | A1 * | 2/2006 | Golesh et al. | 482/142 |
| 2006/0122045 | A1 * | 6/2006 | Webber | 482/142 |

* cited by examiner

*Primary Examiner*—Lori Amerson
(74) *Attorney, Agent, or Firm*—Ober/Kaler; Royal W. Craig

(57) ABSTRACT

An articulated bench comprising a two-section pad and two folding/pivoting support leg assemblies attached to a frame. A length-adjustable (telescoping) dual tubular brace assembly folds out of the frame from beneath the pivoting padded section (i.e. the section for supporting the upper body) and is inserted into one of a series of catches located on the section's rear surface to hold it at a selectable incline. Improved pivoting support leg assemblies include primary foot cross-bars, and secondary foot crossbars each fixedly attached to a leg to either provide lateral floor-support when the support legs are locked in the inwardly stowed position, or alternatively serve as a hand holds or foot rests when the legs are deployed for performing exercises, thereby allowing a broader range of positions and much greater utility. Since either support leg assembly can be folded inward and locked such that the end of the frame may be inclined downward and supported on the secondary foot crossbar, the number of angular positions for the padded sections is effectively tripled.

13 Claims, 9 Drawing Sheets

ARTICULATED BENCH

CROSS-REFERENCE TO RELATED INVENTION(S)

The present application derives priority from U.S. Provisional Patent Application 60/538,542; filed: Jan. 23, 2004.

BACKGROUND OF THE INVENTION

1. Field of the Invention

The present invention relates to support benches such as utilized during body toning, weight training, and other therapeutic activities and, more particularly, to a portable, fully-articulated, multi-purpose bench.

2. Description of the Background

Many different activities such as body toning, weight training, weight-lifting, and other therapeutic and/or athletic activities require the use of a supporting structure capable of supporting the body in a variety of positions. For example, for an effective workout a weight lifter must exercise all major muscle groups by placing themself in a variety of positions ranging from flat-on-his/her-stomach, to reclining, to flat-on-his/her-back, and all at a height that provides a full range of arm or leg motion. Similarly, many body toning exercises, aerobic programs, rehabilitative, and therapeutic activities require the participant to position himself/herself in a variety of seated or lying positions at various angles.

The present inventor is not the first to address the issue of supporting the body during therapy or exercise. A massage-related apparatus is found in U.S. Pat. No. 5,913,271 to Lloyd which discloses a collapsible massage table that has two sides. Each side is supported by a support structure that includes two legs. Various cable lines are used to stabilize the legs when the table is open and upright. The cables also function to automate or semi-automate leg, brace and truss extension and/or folding during opening and collapsing processes.

Additionally, there are other apparatus, primarily associated with weightlifting exercises, designed to support the body in a variety of positions. One variation on this theme is found in U.S. Pat. No. 4,765,616 to Wolff which discloses a workout bench for exercising that includes weightlifting and other bench oriented exercises. A barbell rack is positioned at one end and a laterally extending frame member provides support for a two section bench. The two sections of the bench are mounted on a slider that slides along the length of the laterally extending frame member and can be adjusted and held in any desired position along this length. The bench sections are hinged so that they will both incline, and the position of the hinge is controlled by the slider so that the amount of inclination of the bench back section, which rests against supports on the rack at one end can be changed by sliding the slider to a desired location. The shorter seat bench section can be inclined through the use of a separate support member that will incline the bench at a particular angle and which will move with the slider. The hinge for the bench can be adjusted in position relative to the rack so that barbells supported on the rack can be lifted properly.

A second weightlifting-related apparatus is found in U.S. Pat. No. 4,645,196 to Christie. That patent discloses a weightlifter's bench which can be folded into a compact form suitable for storage. The folding feature is provided by a frame made of two facing U-shaped members which can be engaged by bolts which slide within the frame. Two support panels positioned upon the frame are hinged together to facilitate folding and also to permit one panel to be inclined for special exercises. The frame is supported by four legs which pivot about the frame for storage and can be locked into position by brackets pivoted to the legs and adapted to be secured to the underside of the frame. Support posts are provided for a barbell, and leg exercising means may be provided.

A third apparatus is found in U.S. Pat. No. 4,960,277 to LaRossa et al. which discloses a light-weight foldable weightlifter's bench. The bench is equipped with adjustable barbell receivers and a positionable back support. A fold up frame supporting a top bench pad can be quickly folded to nearly a flat position for storage such as under a bed. The invention is structured in the form of a foldable frame which supports an attached padded panel in the manner of a slant board. The padded panel is transversely hinged centrally so a back rest section can be raised and lowered according to the requirements of the user. The foldable frame when opened for use has a horizontally positioned generally rectangular pad support frame, simply called a pad frame, which is supported at each end by vertically positioned leg frames.

U.S. Pat. No. 5,882,283 to Stevens discloses yet another foldable weightlifting bench that includes a pair of supporting members, each having a post and a transverse bar connected to a lower end of the post. A first connecting rod and a second connected rod are respectively connected between the two posts and the two transverse bars. A base member is pivotally connected to the first connecting rod and located between the two posts, the base member having a stand pivotally connected thereto. A retractable device pivotally connected between the second connecting rod and the base member. A link pivotally connected between the stand and the retractable device. The base member is pivoted about the first connecting rod and the retractable device is then extended to support the base member positioned at an upright position.

Finally, U.S. Pat. No. 6,287,243 to Isom et al. discloses a multi-adjustable exercise bench having a frame assembly, a back rest pivotally connected to the frame assembly, and a bottom rest pivotally connected at a first pivot to the back rest at a location spaced apart from the pivotal connection of the back rest to the frame assembly and pivotally connected at a second pivot to the frame assembly. Adjustment of the frame assembly to move the back rest from a first angle to a second angle relative to a bench supporting surface automatically moves the bottom rest from a first angle to a second angle relative to the back rest.

Unfortunately, the prior art devices of Lloyd, Wolff, Christie, LaRossa et al., and Stevens possess designs specific to use either for massage or weightlifting purposes. The massage table of Lloyd, while collapsible, does not provide the upper/lower body support in an inclined position required by weightlifting or other exercise programs. The utility of the Wolff, Christie, LaRossa et al., and Stevens devices for non-weightlifting purposes is compromised by the presence of barbell support posts. These vertically extending posts limit access, for example, by a therapist, to an individual lying prone on the surface located there between, and establish a size (i.e. width) restriction for persons intending to use the associated device. The Isom et al. apparatus is not collapsible/foldable and does not provide adjustment of the back rest that is independent of the position of a bottom rest.

In light of the shortcomings of prior art exercise benches, it is desirable to have a relatively simple adjustable exercise bench which can be placed in a horizontal position and which also can provide multiple back rest angles for supporting the body in a variety of non-vertical positions.

U.S. Pat. No. 6,805,409 to Parker issued Oct. 19, 2004, discloses an articulated bench comprising a two-section pad attached to a rectangular frame and two folding/pivoting support leg assemblies. This bench includes a U-shaped support assembly folds out of the frame from beneath the longer of the two pivoting, padded end sections (i.e. the section for supporting the upper body) and is inserted into one of a series of catches located on the section's rear surface to hold it at a selectable incline. The support assembly offers a wide range of user-selectable inclines. However, the main frame remains vertical, and the user attains a variety of non-vertical positions by adjusting the pad inclines. It has been found that an exponentially wider range of inclines is possible by additionally utilizing an improved support leg assembly. An apparatus of this type should also be easily and quickly collapsible to allow for easy storage, lightweight for optimum portability, and economical to manufacture in order to provide for widespread use. It is further desirable to provide a light-weight portable folding bench with extremely sturdy adjustment mechanisms for positioning and locking the back rest in a full spectrum of positions, and for locking the support legs in either an open or folded/collapsed position. The present invention provides all of the above mentioned desirable features in a multi-adjustable multi-purpose bench with improved flexibility and range of positions.

SUMMARY OF THE INVENTION

It is, therefore, an object of the present invention to provide an improved apparatus for supporting the body in a variety of non-vertical positions for a variety of activities, including body toning, weight training, weight-lifting, and other therapeutic activities.

It is another object of the present invention to provide an improved apparatus for non-vertical support of the body that may be adjusted to a variety of inclined positions.

Yet another object of the present invention is to provide an improved apparatus for non-vertical support of the body that supports the upper section of the body in a wide variety of inclined positions.

It is still another object of the present invention to provide an improved apparatus for non-vertical support of the body in the above-described manner that is quickly and easily collapsible, lightweight and portable.

It is another object of the present invention to provide lightweight portable bench with sturdy locking joints to reduce the propensity for accidents.

These and other objects are accomplished by an articulated bench that generally comprises a two-section pad attached to a frame comprised substantially of a single section of structural tubular stock with two folding/pivoting support leg assemblies. One padded section is pivotally attached to the frame, the second padded section is fixedly attached to the frame. The pivoting padded section may be locked at a selectable incline. A length-adjustable (i.e. telescoping), dual tubular brace assembly is pivotally attached, at a first end, to the frame at a point beneath the pivoting padded section (i.e. the section for supporting the upper body). A second end of the brace assembly may be inserted into any one of a plurality of pairs of catches located on the pivoting padded section's rear surface to hold it in an inclined position.

The present apparatus also includes improved support leg assemblies for attaining an exponentially wider range of inclines. One each of the support leg assemblies is pivotally mounted at each end of the frame. The two support leg assemblies include primary foot crossbars, may be independently pivoted outward from an inwardly-stowed position to a deployed position for resting on the feet cross-bars. In addition, both of the support leg assemblies include a secondary foot crossbar that is fixedly attached to the leg approximately halfway between the primary foot crossbar and the point of pivoting. These secondary foot crossbars either provide lateral floor-support to the frame when the support leg assembly is locked in the inwardly stowed position, or when deployed at approximately a 110 degree angle (away from the frame) serve as a hand hold or foot rest for use while performing the activities associated with the present invention, thereby allowing a broader range of positions and much greater utility to the bench. The support leg assemblies pivot about axles affixed to the frame and are locked in either the outwardly extended, or inwardly stowed positions via a snap pin/bracket assembly. Thus, in the preferred embodiment to be described where the length-adjustable dual tubular brace assembly can be locked in any of four positions, and the second end of the brace assembly may be inserted into either of two pairs of catches located on the pivoting padded section's rear surface (or left flat and unattached), it becomes possible to set the padded section in any of nine angular positions, beginning at horizontal. Moreover, since either support leg assembly can be folded inward and locked such that the end of the frame may be inclined downward and supported on the secondary foot crossbar, the number of angular positions for the padded sections is effectively tripled to twenty-seven. Of course, the total number of incline positions may be increased by increasing the number of locked positions of the telescoping tubular brace assembly, or by increasing the number of pairs of catches located on the pivoting padded section's rear surface.

The frame construction combined with the design of the support leg assemblies result in an articulated bench with maximum number of incline positions, increased lateral stability in all such positions, and yet reduced manufacturing costs.

The articulated bench of the present invention is fabricated of a variety of strong, light-weight materials to provide the durability and portability required by the nature of its usage. The present invention's design is simple and straightforward, and can be economically manufactured.

BRIEF DESCRIPTION OF THE DRAWINGS

Other objects, features, and advantages of the present invention will become more apparent from the following detailed description of the preferred embodiments and certain modifications thereof when taken together with the accompanying drawings. in which.

DETAILED DESCRIPTION OF THE PREFERRED EMBODIMENTS

Figure 1:
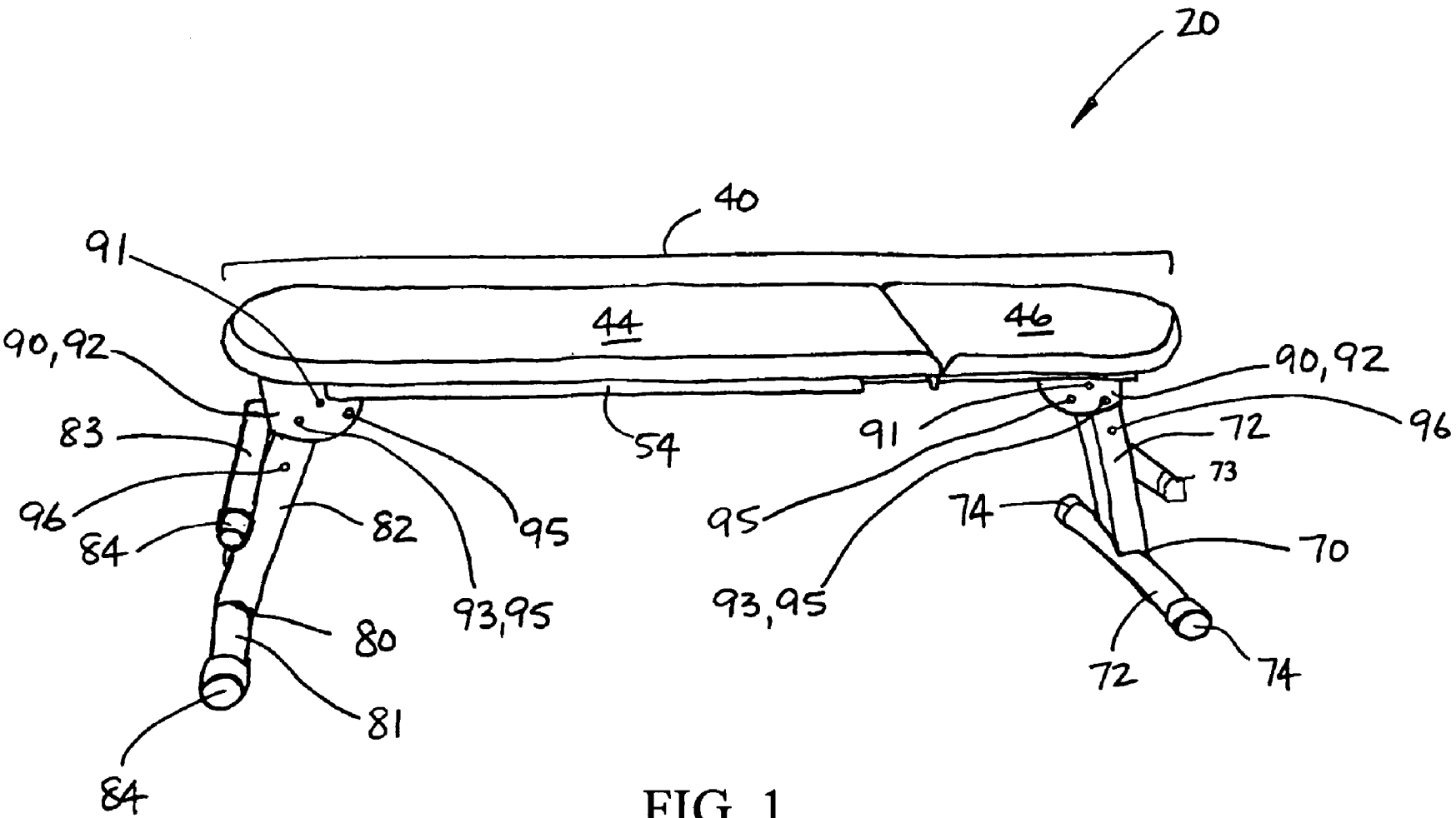
FIG. 1 is a side perspective view of an articulated bench 20 according to a first embodiment of the present invention.
Figure 2:
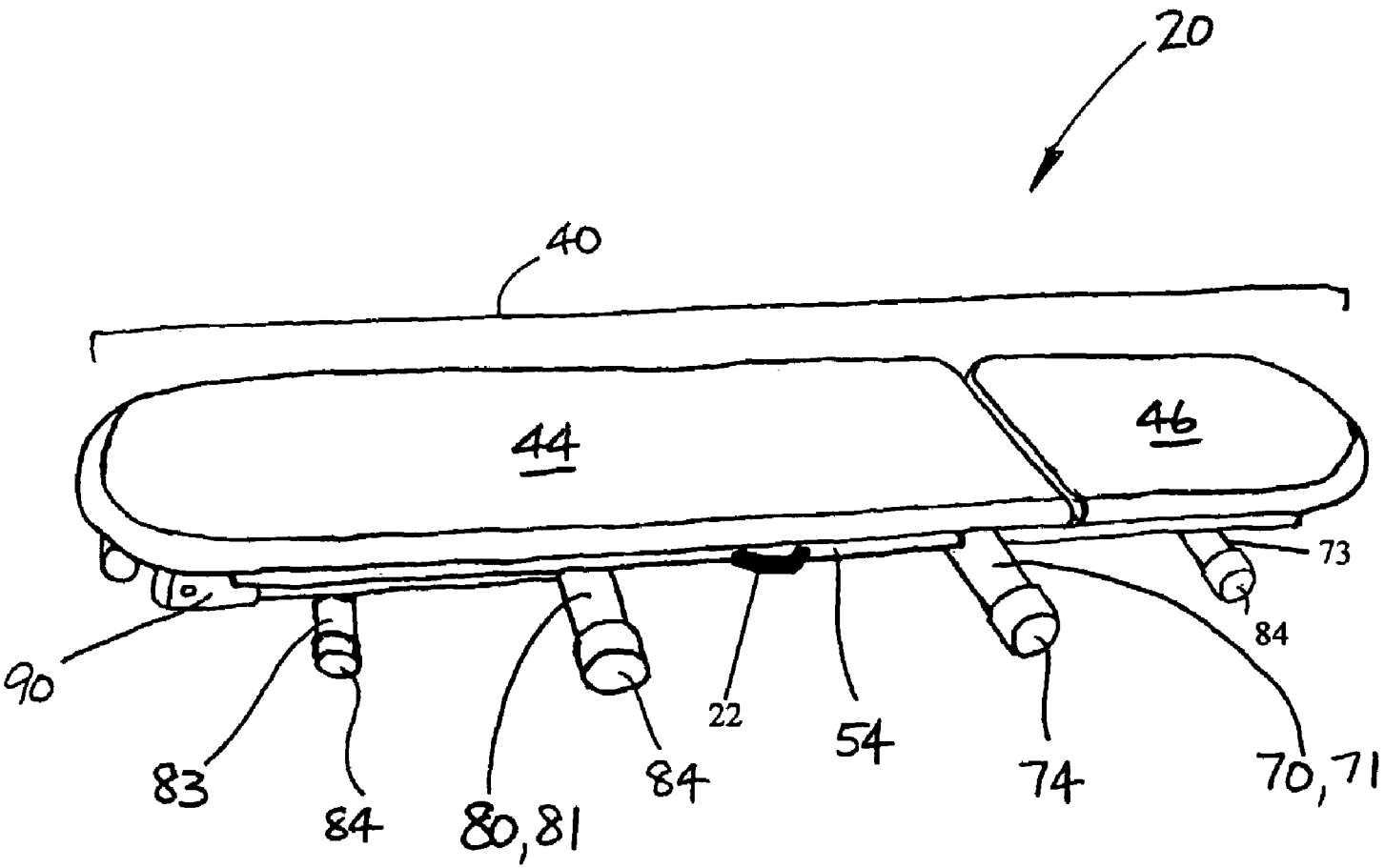
FIG. 2 is a top perspective view of the articulated bench 20 of FIG. 1 shown in a fully collapsed configuration.
Figure 3:
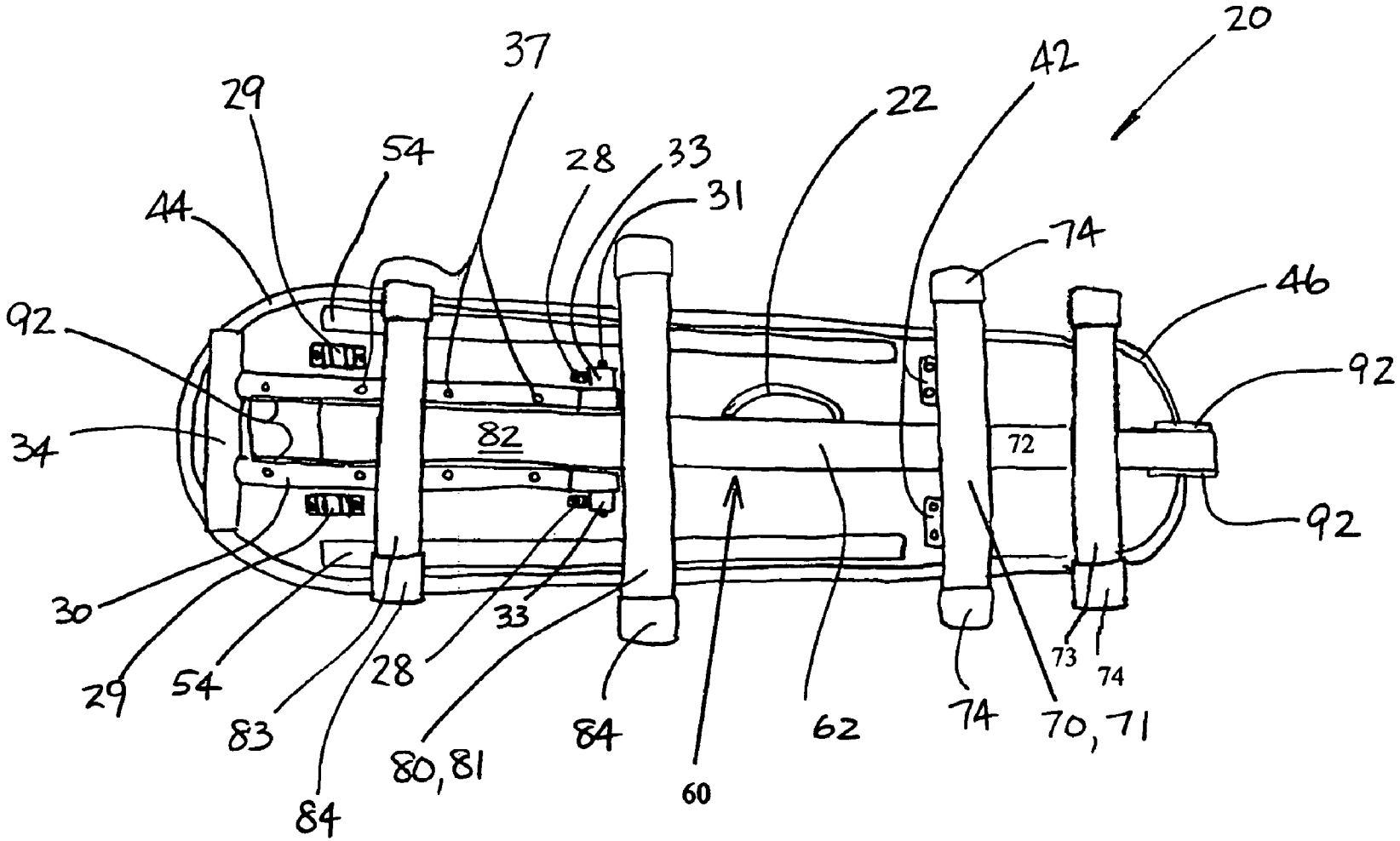
FIG. 3 is a bottom perspective view of the articulated bench 20 of FIGS. 1 and 2 shown in a fully collapsed configuration.
Figure 4:
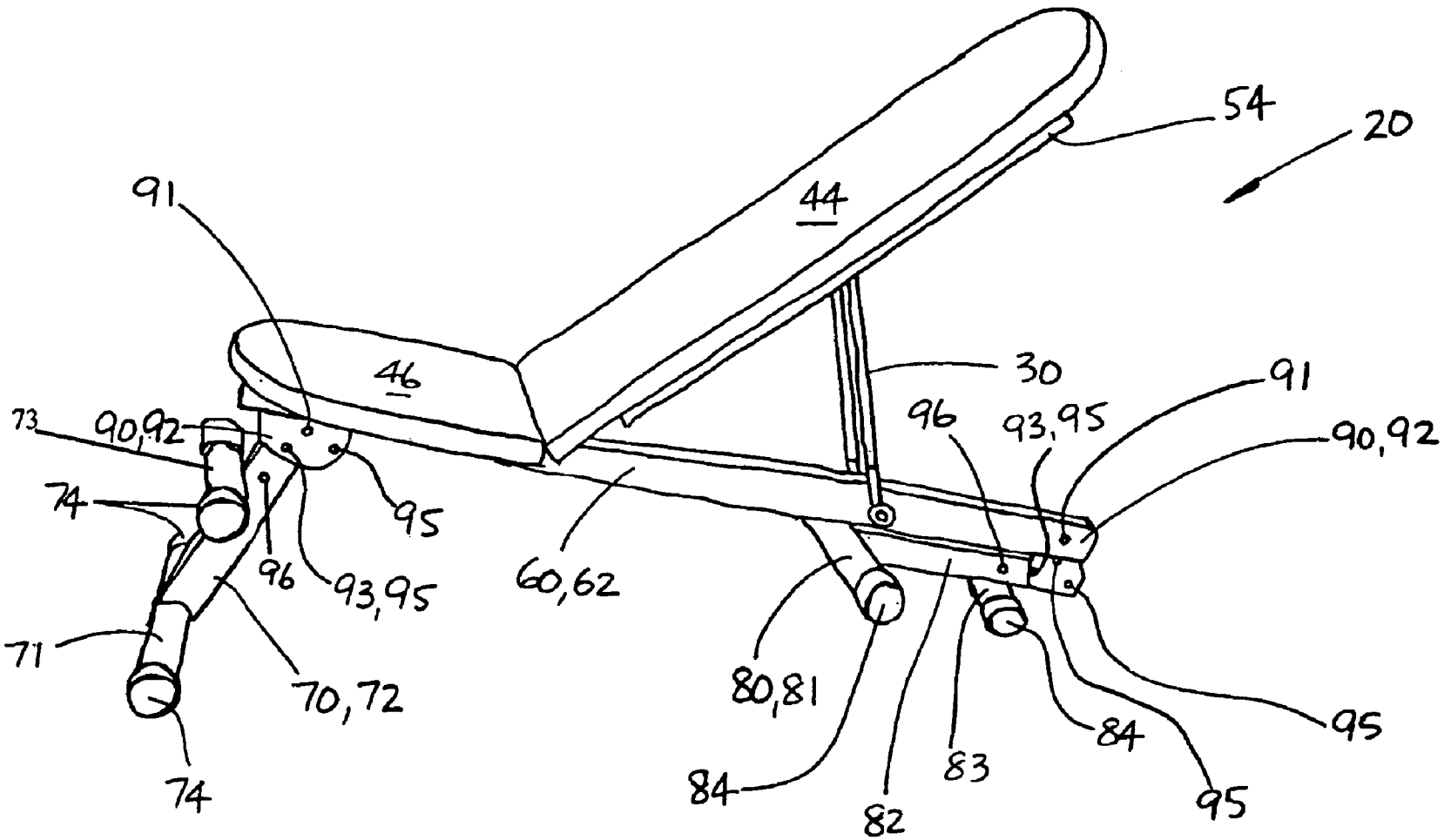
FIG. 4 is a side perspective view of the articulated bench 20 of FIGS. 1-3 shown with padded section 44 set to an inclined position, front leg assembly 70 in an extended position, and rear leg assembly 80 in a folded (or collapsed) position.
Figure 5:
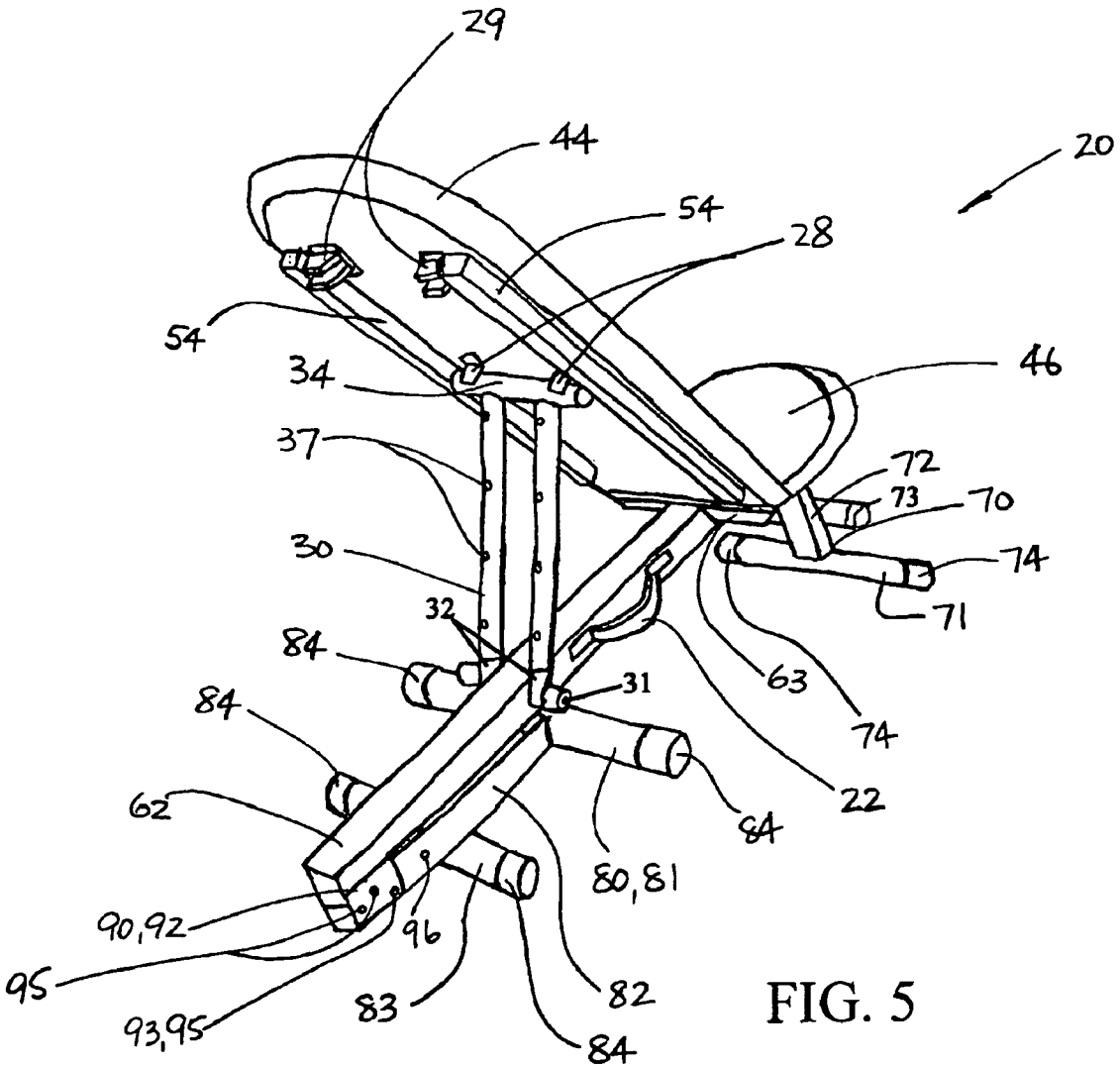
FIG. 5 is a rear perspective view of the articulated bench 20 of FIGS. 1-3 shown with padded section 44 set to an inclined position, front leg assembly 70 in an extended position, and rear leg assembly 80 in a folded (or collapsed) position.

FIG. 1 is a side perspective view of an articulated bench 20 according to a first embodiment of the present invention. FIGS. 2 and 3 are, respectively, top and bottom perspective views of the articulated bench 20 of FIG. 1 shown in a fully collapsed configuration. FIGS. 4 and 5 are, respectively, side and rear perspective views of the articulated bench 20 of FIGS. 1-3 shown in one of its many erect configurations.

As seen in FIGS. 1-3, the articulated bench 20 according to the present invention generally comprises a two-section supporting surface 40, a frame 60, and two folding/pivoting support leg assemblies 70, 80.

Referring to FIGS. 3 and 5, the frame 60 is preferably a fixed assembly configured in the form of a cross and including lengthwise member 62 and cross member 63 (see FIG. 5). The lengthwise member 62 is preferably fabricated of steel or aluminum tubular stock for increased structural strength, the stock being cut to an appropriate length. The cross member 63 may likewise be formed of steel or aluminum tubular stock or may be angle brackets, as desired, then welded to form the cross-shaped frame 60. The tubular stock used to fabricate the lengthwise member 62 and the cross member 63 may have a square, rectangular, or round cross-section. The frame 60 may be other than cross-shaped without departing from the scope and spirit of the invention. A handle 22 may be centrally and fixedly attached along one side of the lengthwise member 62 to assist in carrying/transporting the bench 20 in its fully collapsed/folded configuration (shown in FIG. 2).

The two-section supporting surface 40 comprises a first padded section 44 for supporting the user's back and that is pivotally attached by one or more hinges 42 to cross member 63, and a second padded section 46 to serve as a seat and that is fixedly attached to both frame members 62, and 63. As seen in FIGS. 4 and 5, the first padded section 44 may be pivoted upward and locked into any one of a number of discrete user-selectable positions ranging from horizontal (i.e. angle of inclination equal to 0 degrees—see FIGS. 1 and 2) to vertical (i.e. angle of inclination equal to 90 degrees, or first padded section 44 positioned perpendicular to second padded section 46).

Figure 6A:
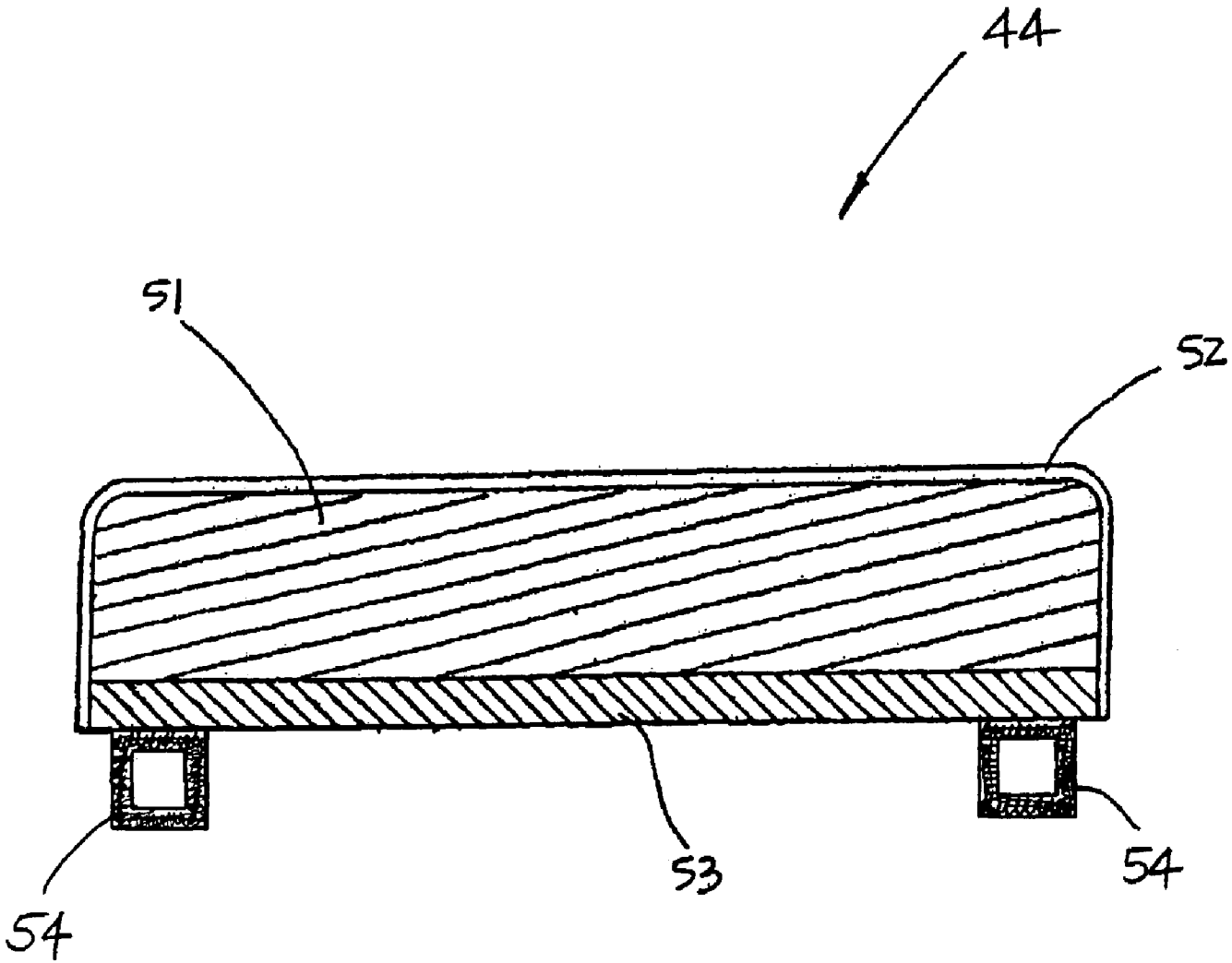
FIGS. 6A and 6B are cross-sectional views of padded sections 44 and 46, respectively.
Figure 6B:
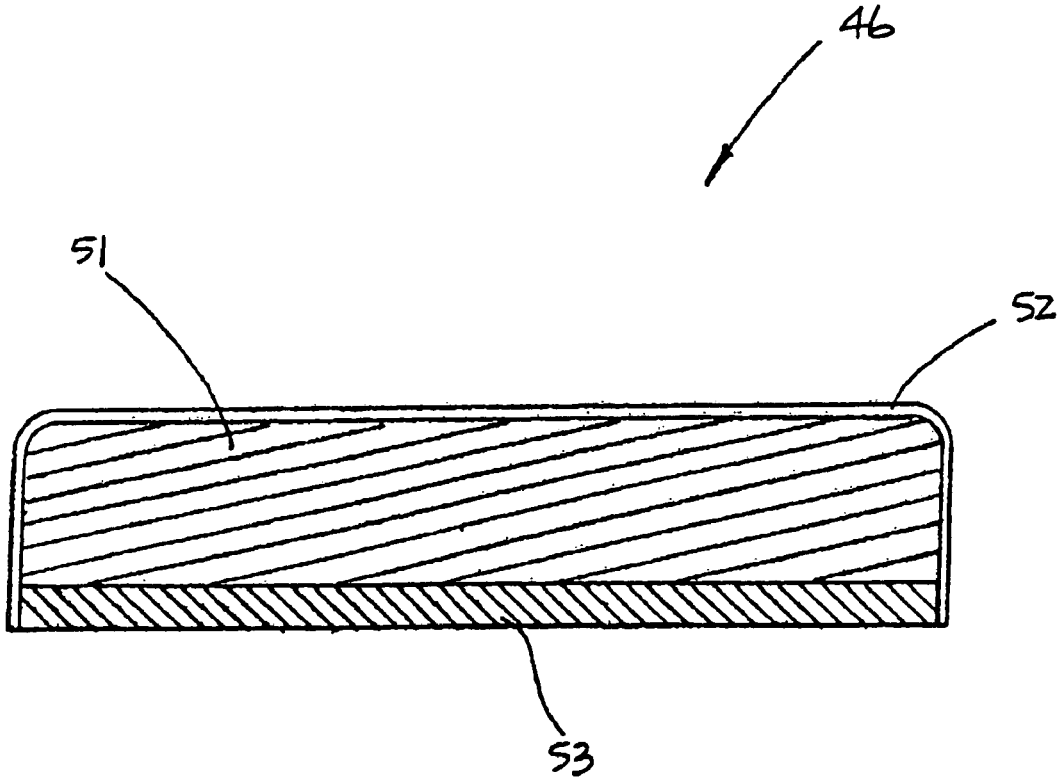

FIGS. 6A and 6B are cross-sectional views of the padded sections 44 and 46, respectively. Both of the padded sections 44, 46 include a layer of padding 51 with a pliable covering 52 fixedly attached to a support board 53. The layer of padding 51 may be of any thickness and any commercially available material that provides a suitable degree of cushioning when the weight of a body is applied. The pliable covering 52 is typically a commercially available plastic sheet material such as vinyl. The support board 53 is preferably a commercially available, rigid plastic, wood or composite material. As shown in FIG. 6A, the first padded section 44 may include two lateral members 54 fixedly attached (e.g. bolted) lengthwise along two edges of the board 53 to add structural integrity/rigidity to the section 44. This is of particular importance when the padded section 44 is set at any angle of inclination other than zero degrees and is, therefore, no longer receiving support from contact with the lengthwise frame member 62. The lateral members 54 are preferably fabricated of rectangular steel or aluminum tubular stock to resist twisting when in a horizontal position. The second padded section 46 does not require the additional structural integrity/rigidity provided by one or more, edge-mounted, lateral members due to its overall shorter length and its fixed attachment to the frame's cross member 63 and one end of the lengthwise member 62.

As best seen in FIGS. 4 and 5, the first padded section 44 may be supported in any one of a variety of inclined positions by a length-adjustable (telescoping) dual tubular brace assembly 30 that folds upward/outward from the frame 60.

Figure 7:
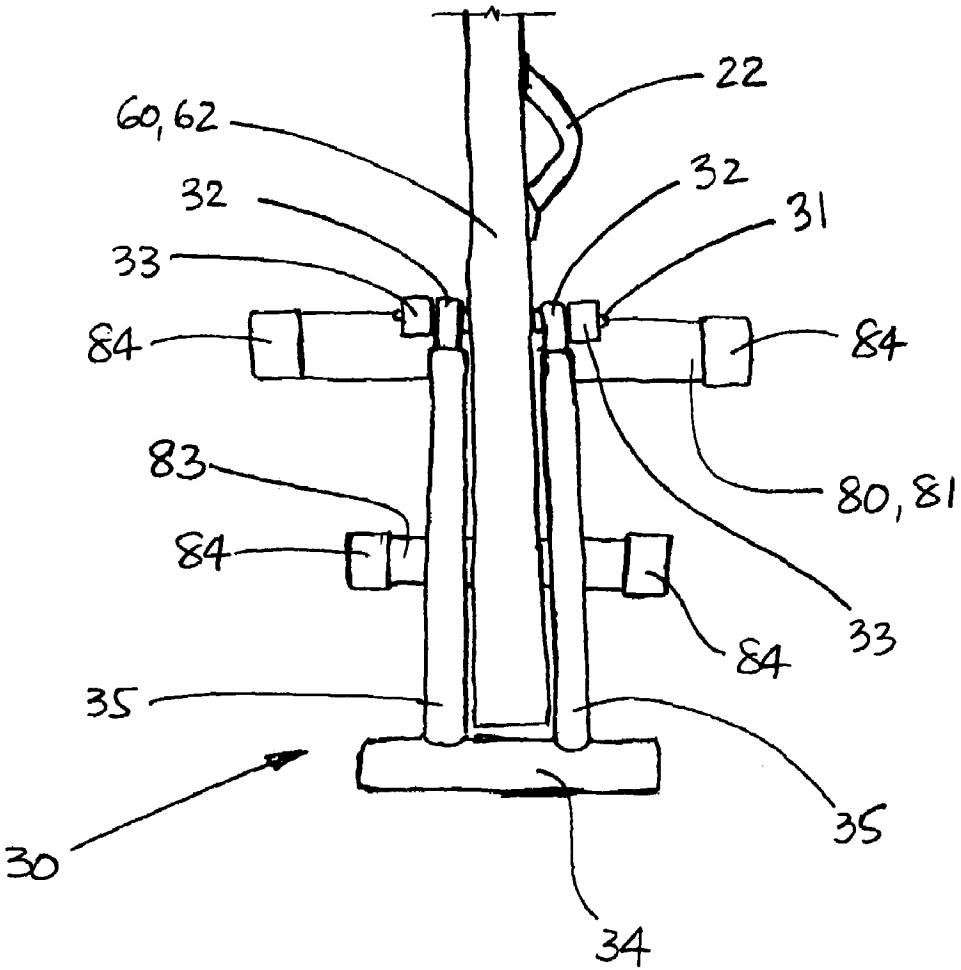
FIG. 7 is a close-up, top view of the length-adjustable (telescoping) dual tubular brace assembly 30.

FIG. 5 presents a contextual view of the length-adjustable (telescoping) dual tubular brace assembly 30, while FIG. 7 is a close-up, top view. With combined reference to FIGS. 5 and 7, the dual tubular brace assembly 30 comprises an axle 31, two lower extension members 32, two rollers 33, a crossbar 34, and two upper extension members 35.

The two lower extension members 32 pivot, with respect to the lengthwise member 62 of the frame 60, via an axle 31 that extends transversely through the member 62. The rollers 33 are rotatably attached to the axle 31 proximate its endpoints. The upper extension members 35 are slightly larger in diameter than the lower extension members 32 and are, therefore, adapted for a telescoping fit. In addition, each of the upper extension members 35 is defined by a series of indexing holes 37. A detent ("snap") button (obscured in the Figures) is loaded into each of the lower extension members 32, to cooperate with the indexing holes 37, to complete the length-adjustable (telescoping) dual tubular brace assembly 30. The extension members 32, 35 and crossbar 34 are preferably fabricated of tubular (i.e. circular cross-section) steel or aluminum stock. The axle 31 is preferably fabricated of round, steel or aluminum stock. The rollers 33 are preferably fabricated of round, plastic (e.g. polypropylene) or wood stock.

As seen in FIG. 5, the crossbar 34 may be detachably attached to any one of a plurality of pairs of catches 28, 29 located on the back of the first padded section 44 to lock the first padded section at a desired angle of inclination. The rollers 33 may be detachably attached to catches 28, thereby avoiding the use of the brace assembly 30 entirely, to lock the padded section 44 against the frame 60 when no angle of inclination is required, or to assist in configuring the bench 20 in its fully collapsed state (for transport) or no-angle-of-inclination configuration. The catches 28, 29 are preferably resilient partially-open yokes fabricated of a semi-rigid plastic wherein the distal ends of the yoke must be forced apart slightly to seat and hold either the crossbar 34 or the rollers 33 there between. The angle of inclination of the padded section 44 is thus established in part by the degree of extension/retraction of the dual tubular brace assembly 30 in combination with the pair of catches 28, 29 into which the user has inserted the crossbar 34. Thus, in the illustrated embodiment where the length-adjustable dual tubular brace assembly 30 can be extended and locked in any of four indexing holes 37, and the crossbar 34 may be attached to either of two pairs of catches 28, 29 located on the back of the first padded section 44 (or left flat and unattached), it should be apparent that the user can easily adjust the tubular brace assembly 30 to set the padded section 44 in any of nine angular positions, beginning at horizontal.

Additionally, the angle of inclination of the padded section 44, relative to the surface on which the bench 20 is sitting, may be modified by adjusting the position of leg assembly 80 (see detailed discussion below) to maximize the number of user-selectable inclines.

With reference to FIGS. 1-5, the folding/pivoting support leg assemblies 70, 80 pivot downward/outward from the frame 60 to a 110 degree extended position, or fold upward/inward (i.e. toward the frame 60) for storing or transporting the bench 20 or for establishing alternate the user-desired angles of inclination for each of the padded sections 44, 46.

The front leg assembly 70 is pivotally mounted at the end of the frame 60 located beneath the second padded section 46. The leg assembly 70 includes a foot crossbar 71, a central member 72, a secondary foot crossbar 73 and two-position locking pivot assembly 90. The foot crossbar 71, secondary foot crossbar 73 and central member 72 are preferably fabricated of commercially available, rigid tubular steel or aluminum. Both the secondary foot crossbar 73 and foot crossbar 71 may be equipped with two, commercially available, rubber/plastic end caps 74 to increase the coefficient of friction between the leg assembly 70 and the surface on which the bench 20 is positioned.

The rear leg assembly 80 is likewise pivotally mounted at the end of the frame 60 located beneath the first padded section 44. The leg assembly 80 includes a primary foot crossbar 81, a central member 82, a secondary foot crossbar 83, and a locking pivot assembly 90. The primary foot crossbar 81, central member 82, and secondary foot crossbar 83 are preferably fabricated of commercially available, rigid tubular steel or aluminum. Each of the foot crossbars 81, 83 may be equipped with two, commercially available, rubber/plastic end caps 84 to increase the coefficient of friction between the leg assembly 80 and the surface on which the bench 20 is positioned.

Each locking pivot assembly 90 includes an axle 91, and a two-position bracket 92 that allows each leg assembly 70, 80 to be pivoted closed or open (110 degrees from the closed or folded position). The bracket 92 is defined by two pairs of holes to demarcate the open and closed position, and a single detent (or "snap") button 93 is inserted inside the central member 72, 82 of each leg assembly 70, 80 to provide spring-biased locking snap-buttons that cooperate with the selected holes 95 in bracket 92. Preferably, an integral detent release mechanism 96 is provided for more convenient unlocking of snap member 93. In an alternative embodiment, the detent release mechanism 96 is omitted and the snap member 93 is disengaged from the selected holes 95 by pressing directly on the spring-biased locking snap-buttons.

Each bracket 92 is fixedly attached to the lengthwise member 62 of the frame 60, and preferably fabricated of commercially available aluminum or like material. The axle 91, preferably fabricated of round, steel or aluminum stock, extends through the brackets 92 to provide a pivoting connection for one of the leg assemblies 70, 80. The snap member 93 may be a simple U-shaped section of resilient spring steel with detent snap-buttons at each end that extend out of the sides of the central member 72, 82 of a leg assembly 70, 80 to cooperate with the series of holes 95 in the brackets 92, and thereby lock the leg assembly 70, 80 in a user-desired position. The release 96 may be an extension of snap member 93 having a distal detent button for leveraged release and press-unlocking.

The overall construction of the front leg assembly 70 is as follows. The central member 72 is fixedly attached perpendicularly to the foot crossbar 71 at a point that is midway along crossbar's length. The secondary foot crossbar 73 is, proximate its midpoint, fixedly attached perpendicularly to the central member 72 approximately halfway between the primary foot crossbar 71 and the point where the leg assembly 70 is pivotally connected to the frame 60. The assembly 70 rotates around the axle 91 to an angle that is 110 degrees from the frame's lengthwise member 62, and locks into one of the two user-desired positions (open or closed) when the snap buttons 93 snap into one of the series of holes 95 located in the brackets 92. The secondary foot crossbar 73 may serve as either a hand hold or a foot rest while performing the activities associated with the articulated bench 20 of the present invention.

The overall construction of the rear leg assembly 80 is as follows. The central member 82 is fixedly attached perpendicularly to the foot crossbar 81 at a point that is midway along crossbar's length. The secondary foot crossbar 83 is, proximate its midpoint, fixedly attached perpendicularly to the central member 82 approximately halfway between the primary foot crossbar 81 and the point where the leg assembly 80 is pivotally connected to the frame 60. The assembly 80 likewise rotates, to an angle that is 110 degrees from the frame's lengthwise member 62, around the axle 91 extending through the pivot assembly's brackets 92, and locks into a user-desired position when the snap buttons 93 snap into one of the series of holes 95 located in the brackets 92. The secondary foot crossbar 83 provides an additional degree of lateral stability when the bench is utilized in the configuration shown in FIGS. 4 and 5 (i.e. with the front leg assembly 70 in an open position and with the back leg assembly 80 in the folded/collapsed position).

The ability to fold the leg assembly 80 inward, and lock it in position such that the end of the frame 60 is inclined downward and supported on the secondary foot crossbar 83, effectively doubles, to eighteen, the number of angular positions available for the padded sections. Thus, the frame 60 construction combined with the design of the support leg assemblies 70, 80 results in an articulated bench with a maximum number of incline positions, and increased lateral stability in all such positions, while reducing manufacturing costs.

In accordance with the unique design of the present invention, setup can be accomplished quickly and easily. With further reference to FIGS. 1-5, the set up process for the articulated bench 20, from its fully collapsed configuration for storage or transportation, begins with the extension of the leg assemblies 70, 80. While holding the bench 20 with one hand via the handle 22, the front leg assembly 70 is extended by depressing and holding the detent snap-release mechanisms 96 while simultaneously pulling on the central member 72. As the central member 72 and foot crossbar 71 move away from the frame 60, after disengaging the snap button 93 from one of the series of holes 95, the central member 72 pivots around the axle 91 until the snap button 93 engages another of the series of holes 95 (i.e. the one locking the leg assembly 70 in the extended, or open position). The rear leg assembly 80 is then similarly extended, while still holding the bench 20 in one hand, by depressing and holding the detent snap-release mechanisms 96 while simultaneously pulling on the central member 82. As the central member 82 and foot crossbar 81 move away from the frame 60, after disengaging the snap button 93 from one of the series of holes 95, the central member 82 pivots around the axle 91 until the snap button 93 engages another of the series of holes 95 (i.e. the one locking the leg assembly 80 in the extended position).

Once both leg assemblies 70, 80 have been positioned and locked in place, the bench 20 can be rotated and set upon the ground or floor (i.e. resting in a stable configuration on foot crossbars 71 and 81). Alternatively, leg assembly 80 can be left in its folded position (resting substantially on secondary foot crossbar 83) to configure the bench 20 with an additional incline, thereby making it more suitable for certain exercises and/or tastes. Furthermore, the angle of inclination for padded section 44 can be adjusted as described above by setting the length-adjustable (telescoping) dual tubular brace assembly 30. Due to its fixed attachment to the frame 60, the angle of inclination for padded section 46 is solely dependent on the position of the leg assemblies 70, 80.

To adjust the angle of inclination for padded section 44, the catch 28 attached to its rear surface must first be disengaged from the rollers 33 by pulling on the distal end of the section 44. This will allow the section 44 to pivot via the hinges 42 as its distal end is moved away from the frame 60. Once the section 44 has been raised sufficiently, the crossbar 34 of the dual tubular brace assembly 30 is grasped and pulled away from frame 60. This causes the brace assembly 30 to rotate around the axle 31. The crossbar 34 is then engaged with one of the plurality of pairs of catches 28, 29 attached to the section's rear surface to lock the padded section 44 at the desired incremental angle of inclination. In between incremental adjustments, the length-adjustable (telescoping) brace assembly 30 may be extended and/or retracted as desired, by repositioning the snap buttons (not shown in these Figures) in each of the upper extension members 35 in another pair of indexing holes 37, to afford a continuous spectrum of intermediate inclination adjustments.

To fold the articulated bench 20 into its fully collapsed configuration for storage or transportation, once the padded section 44 has been locked in position next to frame 60 by engaging the pair of catches 28 with the rollers 33, the central member 72 is then pushed toward the frame 60 once the detent release mechanism 96 is depressed to disengage the snap button 93 from the hole 95 and allow the central member 72 to pivot around the axle 91 until the snap button 93 engages another of the holes 95 (i.e. the one placing the leg assembly 70 in the folded/collapsed position). The rear leg assembly 80 is then similarly collapsed by grasping the central member 82 and pushing it toward the frame 60 once the detent release mechanism 96 is depressed to disengage the snap button 93 from the hole 95 and allow the central member 82 to pivot around the axle 91 until the snap button 93 engages another of the holes 95 (i.e. the one placing the leg assembly 80 in the folded/collapsed position). As with the setup procedure outlined above, the folding of the leg assemblies 70, 80 may be accomplished while holding the bench 20 in one hand via the handle 22.

As an optional and yet useful feature, rubber grommets may be placed inside the two-position brackets 92 to engage the central members 72, 82 of the folding leg assemblies when deployed in order to take up tolerances and to absorb shock.

Figure 8:
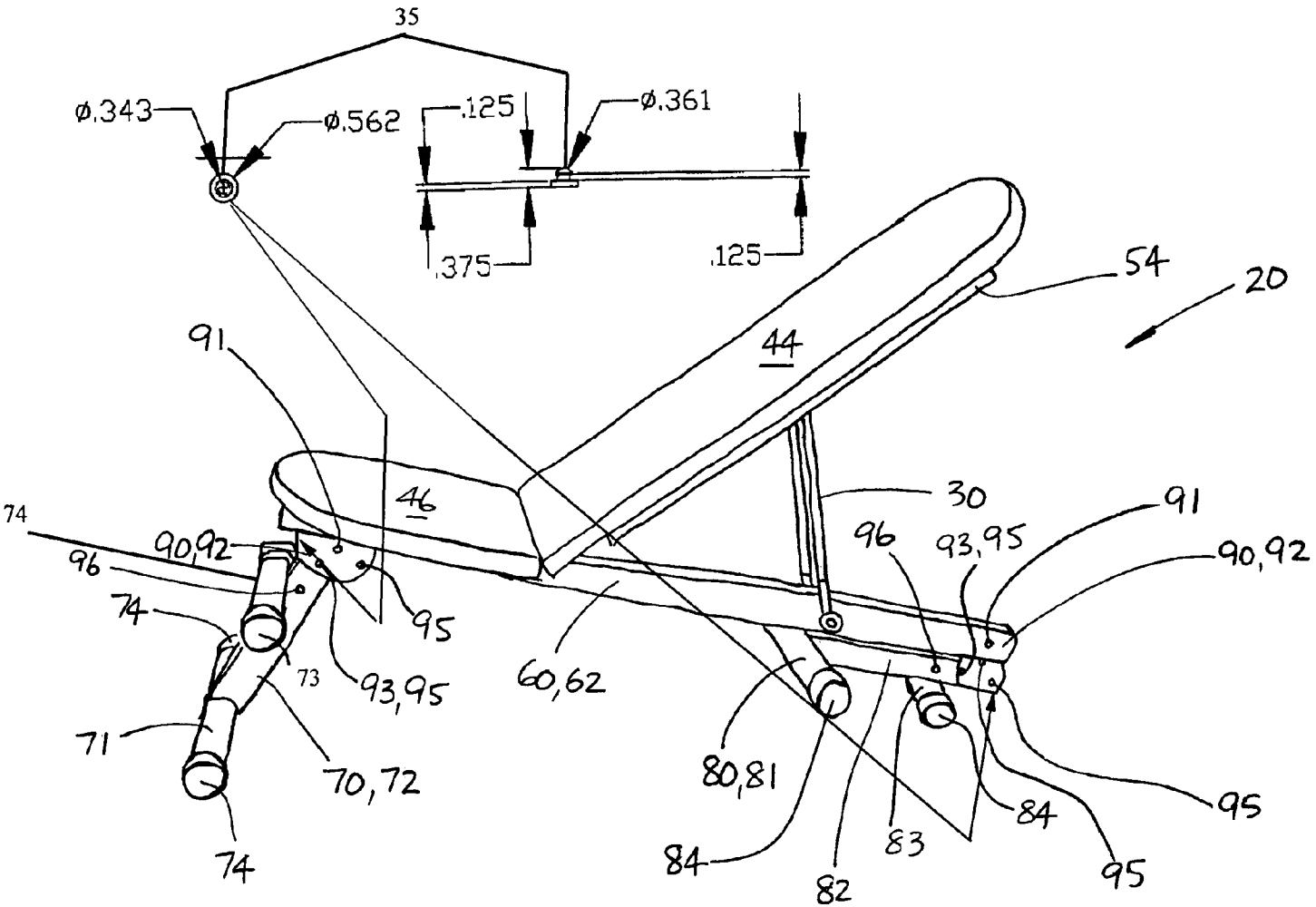
FIG. 8 is a composite view of optional bumper grommets 35 for shock absorption.

FIG. 8 is a composite view of grommets 35 (front and side view at top with exemplary dimensions) illustrating by arrows where they are secured. One grommet 35 is secured to the front of each leg 72, 82 where it opposes the innermost vertical wall of the two-position brackets 92 (as shown by arrows). Thus, when the central members of legs 72, 82 are fully opened grommet 35 become sandwiched between the central members 72, 82 and the two-position brackets 92, and thereby serve as a buffer to take up tolerances and to absorb shock. Both rubber grommets 35 are formed with a protruding snap-fit peg to allow simple press-fit insertion into holes formed in the central members of legs 72, 82. The rubber grommets 35 are preferably 60 durometer black SBR rubber, and they impart a much more solid feel to the user.

As is readily perceived in the foregoing description, the present invention's design is simple, lightweight and straightforward, and can be economically manufactured. Its combination of flexibility, structural strength and ease of setup allows for a myriad of uses in athletics and/or therapeutics, including weight training exercises and other activities requiring the body to be supported in a non-vertical position. The collapsible nature of its design provides for easy storage and transportation of the articulated bench 20.

One skilled in the art will readily understand that the preferred embodiment described above is illustrative but not limiting, and that variations are possible without departing from the scope and spirit of the invention. For example, rather than a two-section supporting surface 40, a single-section supporting surface comprised of a single longer padded section may be employed. Moreover, the entire padded section may be fixedly attached to frame 60, thereby eliminating the ability to incline the padded section at user-selectable positions and instead relying on the two folding/pivoting support leg assemblies 70, 80 for this.

Having now fully set forth the preferred embodiment and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

I claim:

1. An articulated bench, comprising:

an elongate frame;

a first padded section pivotally attached to said frame at a first pivot point for upward inclination, said first padded section having a plurality of catches spaced lengthwise along an underside;

a second padded section fixedly attached to said frame at a second pivot point proximate said first pivot point behind said first padded section; and a first leg assembly pivotally attached at a third pivot point to one end of said frame for selectable upward or downward deployment, said first leg assembly further comprising a primary foot crossbar for floor-support when said leg assembly is in a downwardly-deployed position, and a second foot crossbar for additional floor-support when said leg assembly is in a upwardly-deployed position, the lateral stability of said bench being optimized regardless of the position of said first leg assembly; and a second leg assembly pivotally attached at a fourth pivot point to an opposing end of said frame for downward extension; and a length-adjustable dual tubular brace assembly comprising parallely-spaced telescoping tubes having adjustable locking detents, said tubes being joined together at one end by a cross-bar and pivotally attached on opposing sides of said frame for pivoting upward extending outward for insertion into at least one of the catches along said first padded section for locking said first padded section at a selectable incline.

2. The articulated bench according to claim 1, wherein said second foot crossbar is exposed to serve as a hand or foot hold when said first leg assembly is in a downwardly-deployed position.

3. The articulated bench according to claim 1, wherein said dual tubular brace assembly further comprises two tubular lower extension members pivotally attached on opposing sides of said frame by an axle extending transversely through said frame, two tubular upper extension members inserted onto said lower extension members for telescoping engagement, a pair of detent locks each engaging a pair of said upper and lower extension members for height-adjustment, and a cross-bar joining said upper extension members and for insertion into one of said plurality of catches along the first padded section.

4. The articulated bench according to claim 3, wherein said dual tubular brace assembly further comprises two rollers, each of said rollers being inserted on said axle on opposing sides of said frame.

5. The articulated bench according to claim 1, wherein said first padded section and second padded section are reinforced by lateral members formed of rectangular tube stock to resist twisting.

6. The articulated bench according to claim 1, wherein said first leg assembly and second leg assembly are both pivotally attached to said frame within four-walled brackets, and a rubber bumper is secured within each of said brackets to buffer engagement by deployment of the leg assemblies.

7. An articulated bench, comprising:

an elongate frame;

a first padded section pivotally attached to said frame at a first pivot point for upward inclination, said first padded section having a plurality of catches spaced lengthwise along an underside;

a second padded section fixedly attached to said frame at a second pivot point proximate said first pivot point behind said first padded section; and a first leg assembly pivotally attached to one end of said frame at a third pivot point for selectable upward or downward deployment, said first leg assembly further comprising a primary foot crossbar for floor-support when said leg assembly is in a downwardly-deployed position, and a secondary foot crossbar for additional floor-support when said leg assembly is in a upwardly-deployed position;

a second leg assembly pivotally attached at a fourth pivot point to another end of said frame for selectable upward or downward deployment, said first leg assembly further comprising a primary foot crossbar for floor-support when said leg assembly is in a downwardly-deployed position, and a secondary foot crossbar for additional floor-support when said leg assembly is in a upwardly-deployed position; and a length-adjustable dual tubular brace assembly comprising parallely-spaced telescoping tubes having adjustable locking detent snap-buttons, said tubes being joined together at one end by a cross-bar and pivotally attached on opposing sides of said frame for pivoting upward extending outward for insertion into at least one of the catches along said first padded section for locking said first padded section at a selectable incline;

whereby the lateral stability of said bench is optimized by said primary and secondary foot cross bars regardless of the positions of said leg assemblies.

8. The articulated bench according to claim 7, wherein both of said secondary foot crossbars are exposed to serve as hand or foot holds when said first and second leg assemblies are in a downwardly-deployed position.

9. The articulated bench according to claim 7, wherein said dual tubular brace assembly further comprises two tubular lower extension members pivotally attached on opposing sides of said frame by an axle extending transversely through said frame, two tubular upper extension members inserted onto said lower extension members for telescoping engagement, a pair of snap-buttons locks each engaging a pair of said upper and lower extension members for height-adjustment, and a cross-bar joining said upper extension members and for insertion into one of said plurality of catches along the first padded section.

10. The articulated bench according to claim 9, wherein said dual tubular brace assembly further comprises two rollers, each of said rollers being inserted on said axle on opposing sides of said frame.

11. The articulated bench according to claim 7, wherein said first leg assembly and second leg assembly are both pivotally attached to said frame within four-walled brackets, and a rubber bumper is secured within each of said brackets to buffer engagement by deployment of the leg assemblies.

12. An articulated bench, comprising:

an elongate frame comprising a single tubular member;

a padded section fixedly attached to said frame;

a first leg assembly pivotally attached to one end of said frame at a first pivot point for selectable upward or downward deployment, said first leg assembly further comprising a primary foot crossbar for floor-support when said leg assembly is in a downwardly-deployed position, and a secondary foot crossbar for additional floor-support when said leg assembly is in a upwardly-deployed position;

a second leg assembly pivotally attached at a second pivot point to another end of said frame for selectable upward or downward deployment, said first leg assembly further comprising a primary foot crossbar for floor-support when said leg assembly is in a downwardly-deployed position, and a secondary foot crossbar for additional floor-support when said leg assembly is in a upwardly-deployed position; and a pair of four-wall brackets attached to said frame at opposite ends, said first leg assembly and second leg assembly both being pivotally attached to said frame within said four-walled brackets for deployment of the leg assemblies.

13. The articulated bench according to claim 11, further comprising a rubber bumper secured within each of said four-wall brackets to buffer engagement by deployment of the leg assemblies.

* * * * *